US005915363A

United States Patent [19]

Iwata et al.

[11] Patent Number: 5,915,363

[45] Date of Patent: Jun. 29, 1999

[54] FUEL SUPPLY SYSTEM FOR AN ENGINE POWERING AN OUTBOARD MOTOR

[75] Inventors: Yoshibumi Iwata; Noriyoshi Hiraoka, both of Hamamatsu, Japan

[73] Assignee: Sanshin Kogyo Kabushiki Kaisha, Hamamatsu, Japan

[21] Appl. No.: 08/954,793

[22] Filed: Oct. 21, 1997

[30] Foreign Application Priority Data

Oct. 21, 1996 [JP] Japan ..... 8-278092

[51] Int. Cl.[6] ..... F02M 37/04

[52] U.S. Cl. ..... 123/497; 123/516

[58] Field of Search ..... 123/514, 516, 123/497

[56] References Cited

U.S. PATENT DOCUMENTS

| | | | |
|---|---|---|---|
| 4,926,829 | 5/1990 | Tuckey | 123/497 |
| 4,940,034 | 7/1990 | Heim et al. | 123/497 |
| 5,138,984 | 8/1992 | Takashima . | |
| 5,309,885 | 5/1994 | Rawlings et al. | 123/516 |
| 5,368,001 | 11/1994 | Roche | 123/516 |
| 5,375,578 | 12/1994 | Kato et al. | 123/516 |
| 5,379,741 | 1/1995 | Matysiewicz et al. | 123/497 |
| 5,389,245 | 2/1995 | Jaeger et al. | 123/497 |
| 5,404,858 | 4/1995 | Kato . | |
| 5,653,103 | 8/1997 | Katoh . | |
| 5,669,358 | 9/1997 | Osakabe . | |
| 5,724,936 | 3/1998 | Osakabe . | |

*Primary Examiner*—Thomas N. Moulis

*Attorney, Agent, or Firm*—Knobbe, Martens, Olson & Bear LLP

[57] ABSTRACT

A fuel supply system for an engine powering an outboard motor is disclosed. The fuel supply system includes a pump for supplying fuel from a tank to a vapor separator. Another pump delivers fuel from the vapor separator to at least one charge former for supplying fuel to the combustion chamber (s) of the engine. The fuel supply system includes a mechanism for reducing the transmission of vapor to the pump which delivers fuel to the charge former(s). In one embodiment, this mechanism is a vapor relief line extending to a point outside of a cowling of the motor in which the engine is positioned. In another embodiment, the mechanism is a pump control, and in yet another, the mechanism is a vapor separator cooling system.

2 Claims, 10 Drawing Sheets

FUEL SUPPLY SYSTEM FOR AN ENGINE POWERING AN OUTBOARD MOTOR

FIELD OF THE INVENTION

The present invention relates to an engine of the type utilized to power an outboard motor. More particularly, the invention is a fuel supply system for an engine positioned within a cowling of an outboard motor and powering a water propulsion device of the motor.

BACKGROUND OF THE INVENTION

Fuel vapors can be problematic in the fuel-supply system for internal combustion engines, especially those of the type in which the fuel is injected with a fuel injector. Fuel vapors are unpredictable and their concentration in the fuel supply system varies. The unpredictability of the vapors causes the charge former to deliver fuel in a ratio to the air which may be leaner or richer than desired, resulting in poor engine performance.

It the past, fuel-vapor separators have been provided along the fuel supply path to separate at least part of the vapor from the liquid fuel. This vapor is typically routed into a intake system of the engine for combustion with the incoming air and fuel charge. The routing of the vapor to the intake system, however, also effects the ratio of the air/fuel charge from that which is intended.

Further, the fuel supply system may be used with an engine positioned in a small confine, such as the cowling of an outboard motor. In these situations, space may be at a premium such that the fuel supply system need be as small and simple in arrangement as possible. The need for a complex vapor routing system may occupy too great of space.

A principal object of the present invention is to provide a fuel supply system for an internal combustion engine, the fuel supply system arranged to reduce the transmission of vapor to the charge former(s) of the engine. Another object of the present invention is to provide such a fuel supply system which has a compact arrangement.

SUMMARY OF THE INVENTION

In accordance with the present invention, there is provided a fuel supply system for an engine of the type utilized to power an outboard motor. Preferably, the engine is positioned in a cowling of the motor and arranged to drive a water propulsion device of the motor. The engine includes at least one combustion chamber.

The fuel supply system preferably includes a vapor separator, first pump means for delivering fuel to said vapor separator, second pump means for delivering fuel from the vapor separator to a charge former for providing fuel to a combustion chamber of the engine, and means for reducing the transmission of vapor within the fuel supply system to the charge former.

In one arrangement, the means for reducing the transmission of vapor includes means for controlling the second pump means to deliver fuel from the separator based on a fuel requirement of the engine, whereby the need for an excess fuel return line to the separator is eliminated, and the vapor production which would otherwise be associated with the fuel return is eliminated.

In a second arrangement, the means for reducing comprises means for cooling the vapor separator, and thus the fuel therein.

In a third arrangement, the means for reducing includes a vapor relief passage extending from the vapor separator to a point external to the cowling of the motor.

Advantageously, the fuel supply system of the present invention is arranged to reduce the transmission of vapor to the charge former(s) of the engine. In this manner, the air/fuel ratio of the charge supplied to each combustion chamber of the engine is more accurately controlled and engine running conditions are improved.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
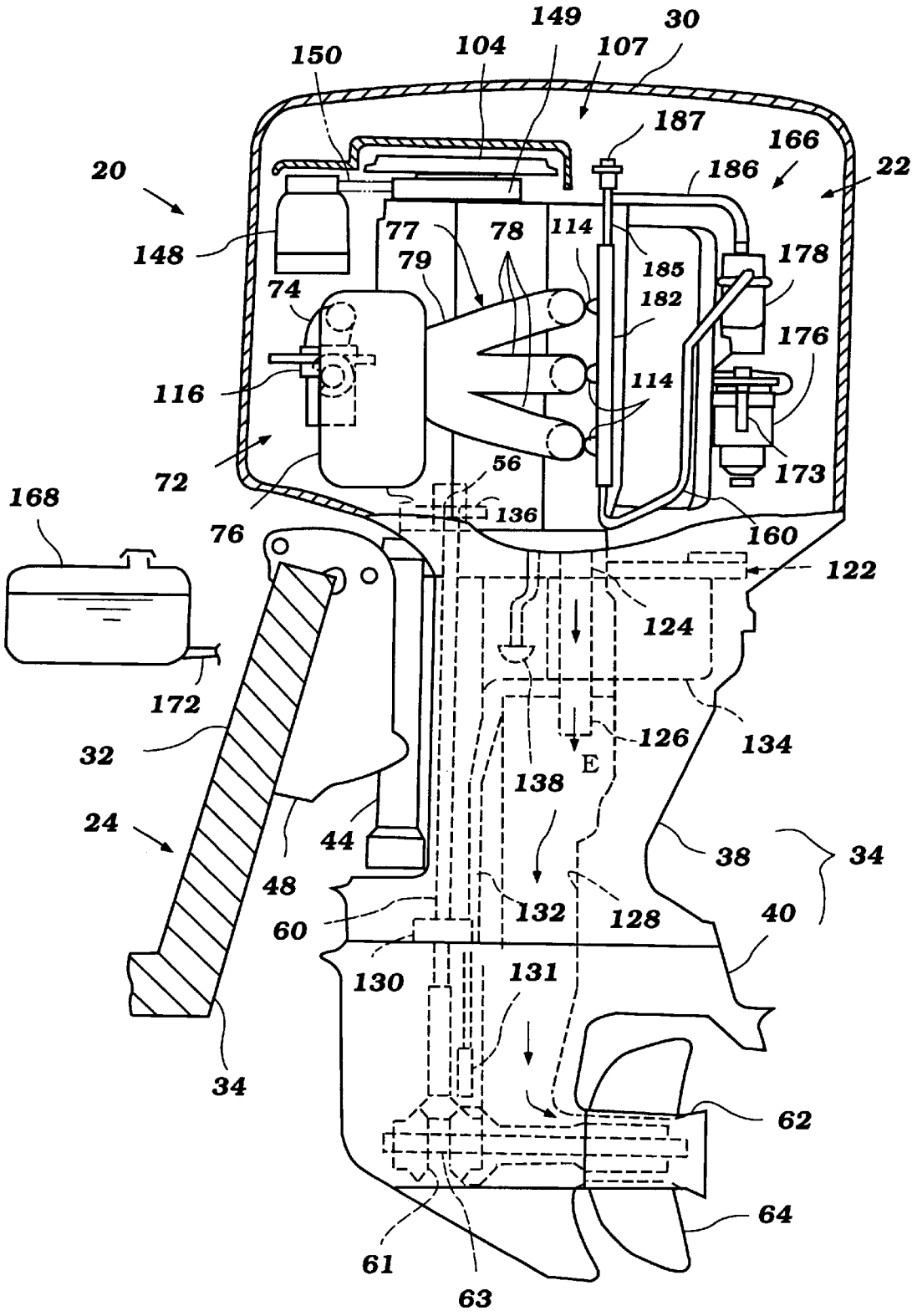
FIG. 1 is a side view, in partial cross-section, of an outboard motor powered by an engine and having a fuel supply system in accordance with a first embodiment of the present invention.

FIG. 1 illustrates an outboard motor 20 powered by an engine 22 and having a fuel supply system in accordance with the present invention. The fuel supply system is described for use with an engine powering an outboard motor 20 since this particular application is one in which the features of the fuel supply system described have particular benefits. It should be understood, however, that the engine 22 which is supplied fuel with the fuel supply system arranged as described may be used in other applications.

As illustrated in FIG. 1, the outboard motor 20 is of the type utilized to propel a watercraft 24. The outboard motor 20 has a powerhead area comprised of a main cowling portion 30. The motor 20 includes a lower unit 34 extending downwardly from the cowling portion 30. The lower unit 34 comprises an upper or "drive shaft housing" section 38 and a lower section 40.

The motor 20 is connected to a steering shaft (not shown). The steering shaft is supported for steering movement about a vertically extending axis within a swivel or steering bracket 44. The swivel bracket 44 is connected by means of a pivot pin (not shown) to a clamping bracket 48 which is attached to a transom portion 32 of a hull 36 of a watercraft 24. The pivot pin permits the outboard motor 20 to be trimmed and tilted up about the horizontally disposed axis formed by the pivot pin.

Figure 2:
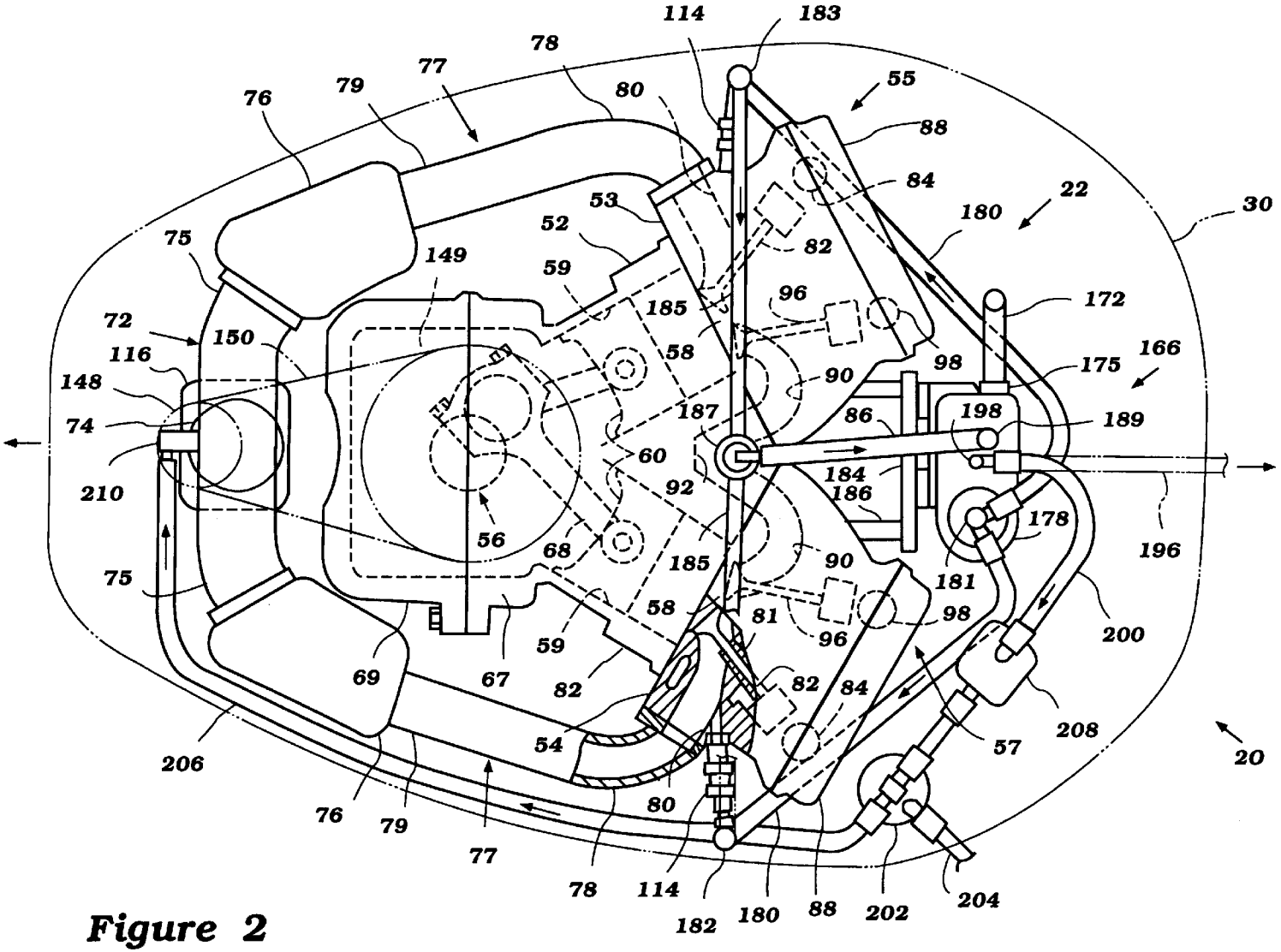
FIG. 2 is a top view of the motor illustrated in FIG. 1, with a cowling of the motor and internal portions of the engine illustrated in phantom.

Referring to FIGS. 1 and 2, the engine 22 is positioned within the cowling portion 30. The engine 22 is preferably of the six-cylinder, four-cycle variety, and is arranged in a "V" fashion. In this arrangement, the engine 22 has a cylinder block 52 with a first cylinder head 53 and a second cylinder head 54 connected thereto and cooperating therewith to define first and second cylinder banks 55,57 defining a valley therebetween. This valley faces away from the watercraft to which the motor 20 is attached. Each bank preferably defines three cylinders 59, each having a combustion chamber 58. As may be appreciated by those skilled in the art, the engine 22 may have a greater or lesser number of cylinders, such as two, four, or eight or more and be arranged in other than "V" fashion, such as in an in-line arrangement.

As illustrated in FIG. 2, a piston 66 is movably positioned in each cylinder 59. Each piston 66 is connected to a connecting rod 68 extending to a vertically extending crankshaft 56. Referring to FIG. 1, the crankshaft 56 is connected to a top end of a drive shaft 60 which extends downwardly through the lower unit 34, where it drives a bevel gear and a conventional forward-neutral-reverse transmission 61. A control (not shown) is preferably provided for allowing an operator to remotely control the transmission from the watercraft 24.

The transmission drives a propeller shaft 63 which is journalled within the lower section 40 of the lower unit 34 in a known manner. A hub 62 of a propeller 64 is coupled to the propeller shaft 63 for providing a propulsive force to the watercraft 24 in a manner well known in this art.

The crankshaft 56 is journalled for rotation with respect to the cylinder block 52. A crankcase cover 69 engages an end of the block 52 generically opposite the heads 53,54, defining therewith a crankcase chamber 67 within which the crankshaft rotates. The crankcase cover 69 may be attached to the cylinder block 52 by bolts or similar means for attaching known to those skilled in the art. The crankcase chamber 67 is positioned generally opposite the heads 53,54 and on the side of the engine closest to the watercraft 24.

Figure 4:
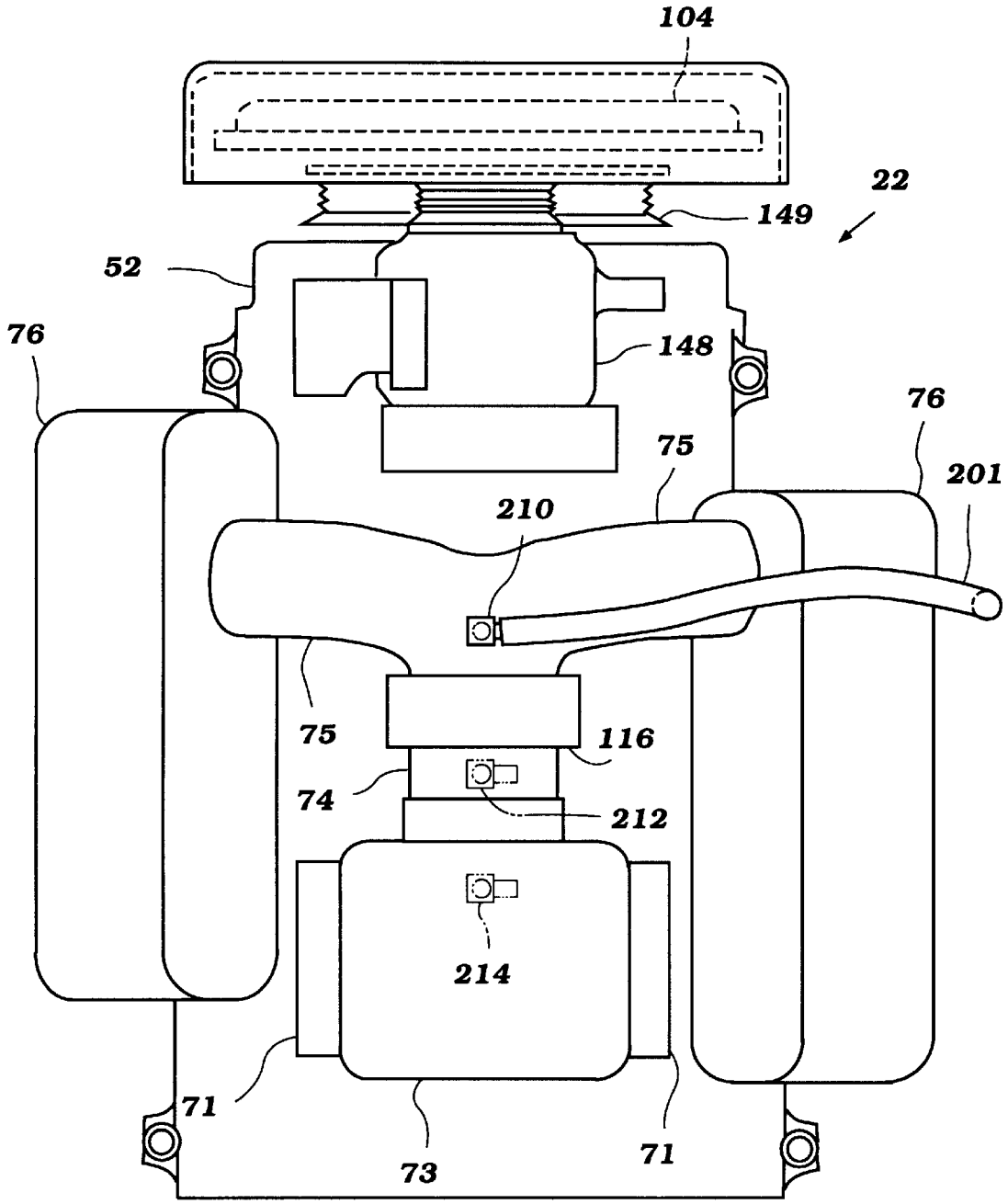
FIG. 4 is an enlarged cross-sectional view of a vapor separator of the fuel supply system illustrated in FIGS. 1–3 in accordance with a first arrangement thereof.

The engine 22 includes an air intake system 72 for providing air to each combustion chamber 58. The intake system 72 is preferably positioned at the crankcase or watercraft end of the engine 22. As best illustrated in FIGS. 1 and 4, air passes through the vent (not shown) in the motor cowling 30 into a pair of inlets 71 leading to a silencer 73. A main pipe intake pipe 74 leads upwardly from the silencer 73.

As best illustrated in FIG. 1, a throttle 116 is provided for controlling the flow of air into the combustion chambers 58. Preferably, the throttle 116 comprises a moveable plate positioned within the intake pipe 74. The throttle 116 is preferably controlled through a cable by the operator of the watercraft.

Branch pipes or passages 75 lead from the main intake pipe 74 to first and second surge tanks 76. A manifold 77 extends from each surge tank 76. Each manifold 77 has a main part 79 connected to the surge tank 76 leading to individual branches 78 extending therefrom. Preferably, each manifold 77 has three branches 78, each branch 78 extending to a passage 80 in the cylinder head 53,54 leading to one of the combustion chambers 58.

Referring to FIG. 2, means are provided for controlling the flow of air into each combustion chamber 58. Preferably, this means comprises at least one intake valve 82 corresponding to each intake passage 80. As illustrated, all of the intake valves 82 for each bank of cylinders are preferably actuated by a single intake camshaft 84. The intake camshaft 84 is mounted for rotation with respect to its respective cylinder head 53,54 and connected thereto with at least one bracket. Each intake camshaft 84 rotates within an enclosure defined by the cylinder head 54,55 and a camshaft cover 88 connected thereto.

Each valve 82 preferably has a head which is adapted for seating against a valve seat in the passage 80, and a stem extending from the head through a valve guide 81 to a follower. A spring is positioned between the follower and a portion of the cylinder head 53,54 for biasing the valve 82 upwardly into a position in which the valve 82 closes the passage 80.

An exhaust system is provided for routing the products of combustion within the combustion chambers 58 to a point external to the engine 22. In particular, an exhaust passage 90 leads from each combustion chamber to a main passage 92. The remainder of the exhaust system is described in more detail below.

Referring still to FIG. 2, means are also provided for controlling the flow of exhaust from each combustion chamber 58 to its respective exhaust passage 90. Preferably, this means comprises at least one exhaust valve 96. Like the intake valves 82, the exhaust valves 96 of each cylinder bank are preferably all actuated by a single exhaust camshaft 98. Each exhaust camshaft 98 is journalled for rotation with respect to its respective cylinder head 54,55 and connected thereto with at least one bracket. Each exhaust camshaft 98 is enclosed within the camshaft cover 88.

As with the intake valve 82, each exhaust valve 96 preferably includes a head for selective positioning against a valve seat in the passage 90. A stem extends from the head of the valve 96 through a valve guide in the cylinder head 53,54. A follower is positioned at the opposite end of the stem for engagement by the camshaft 98. A spring is positioned between the follower and the cylinder head 53,54 for biasing the valve 96 into a position in which the valve closes the passage 90.

Although not illustrated, means are provided for driving the camshafts 84,98. This means for driving may be of a variety of types known to those skilled in the art, such as a toothed gear mounted on the crankshaft, a similar gear mounted to each camshaft, and a timing chain extending in engagement with the gears whereby the crankshaft drives the camshafts.

Referring to FIG. 1, a flywheel 104 is preferably maintained in position on the top end of the crankshaft 56. The flywheel 104 is preferably positioned under a flywheel cover 107.

The remainder of the exhaust system will now be described with reference to FIG. 1. As illustrated, an exhaust guide 122 is positioned at the bottom end of the engine 22. The exhaust guide 122 has a passage 124 extending therethrough which communicates with the common exhaust passage 92. The common exhaust passage 92 extends through the valley of the engine 22 and is defined by the cylinder block 52. As stated above, the individual exhaust passages 90 lead to the common exhaust passage 92.

An exhaust pipe 126 is connected to the bottom side of the exhaust guide 122 in alignment with the passage 124 therethrough. The exhaust pipe 126 terminates within a chamber of a muffler 128.

Referring still to FIG. 1, the muffler 128 is positioned within the lower unit 34 near the drive shaft 60. An exhaust gas outlet is provided in the bottom end of the muffler 128, through which the exhaust gas is routed (in the direction of arrows "E") through the hub 62 of the propeller 64 to a point external of the motor 20.

A suitable ignition system is provided for igniting an air and fuel mixture within each combustion chamber 58. Such systems are well known to those skilled in the art, and as the ignition system forms no part of the present invention, such is not described in detail herein. The ignition system may include a spark plug for use in igniting the air and fuel mixture within each combustion chamber 58.

A cooling system is provided for cooling the engine 22. Referring to FIG. 1, cooling liquid, preferably water from the body of water in which the motor 22 is positioned, is pumped through a water inlet 131 by a water pump 130 positioned in the lower unit 34. The pump 130 is preferably driven by the drive shaft 60, and expels the cooling liquid upwardly through a cooling liquid supply pipe 132. The coolant flows through the supply pipe 132 from the pump 130 to one or more coolant jackets (not shown) for cooling the engine 22, such as the cylinder heads 53,54, block 52, and exhaust system.

The cooling system may include a pressure valve (not shown) positioned along the coolant path for diverting coolant through a relief passage and thereon to the coolant drain system in the even the coolant pressure exceeds a predetermined high pressure. In addition, the cooling system may include a thermostat positioned along the coolant path for monitoring the temperature of the coolant and arranged so that if the coolant temperature is high, the thermostat is opened to allow coolant to flow though the engine 22 at a high rate. On the other hand, if the temperature of the coolant is low, then the thermostat is closed, allowing the engine to warm up. Preferably, the coolant is return through a discharge into the body of water.

Preferably, the engine 22 includes a lubricating system for providing lubricant to the various portions of the engine. Referring to FIG. 1, the lubricating system includes an oil reservoir 134 positioned below the engine 22. The reservoir 134 is in communication with an oil pump 136 via a suction tube 138. The oil pump is drivingly positioned on the end of the crankshaft 56 at the bottom of the engine 22. Seals are provided for sealing the oil pump with respect to the remainder of the engine 22. The oil pump 136 draws lubricant from the reservoir 134 and then delivers it through a connecting passage through galleries leading throughout the engine. The lubricant is then arranged to drain back to the reservoir 134 for reuse. A portion of the cooling system may be arranged to cool the lubricant in the reservoir.

As illustrated in FIG. 1, the engine 22 may include additional engine auxiliary features or accessories such as an alternator 148. Preferably, the alternator 148 is utilized to produce electricity for firing the spark plugs and similar functions. The alternator 148 is run by a belt 150 which is driven by a pulley 149 mounted on the end of the crankshaft 56 just below the flywheel 104. As illustrated in FIG. 1, the alternator 148 is positioned near the top of the engine 22 on the crankcase end of the engine 22 opposite its valley. The engine 22 may also include a starter motor (not shown) for use in starting the engine.

Because of the position of the alternator 148, the air inlet is formed in a lower end of the intake pipe 74. Air passes upwardly through the pipe 74 and is delivered to the surge tanks 76.

Figure 3:
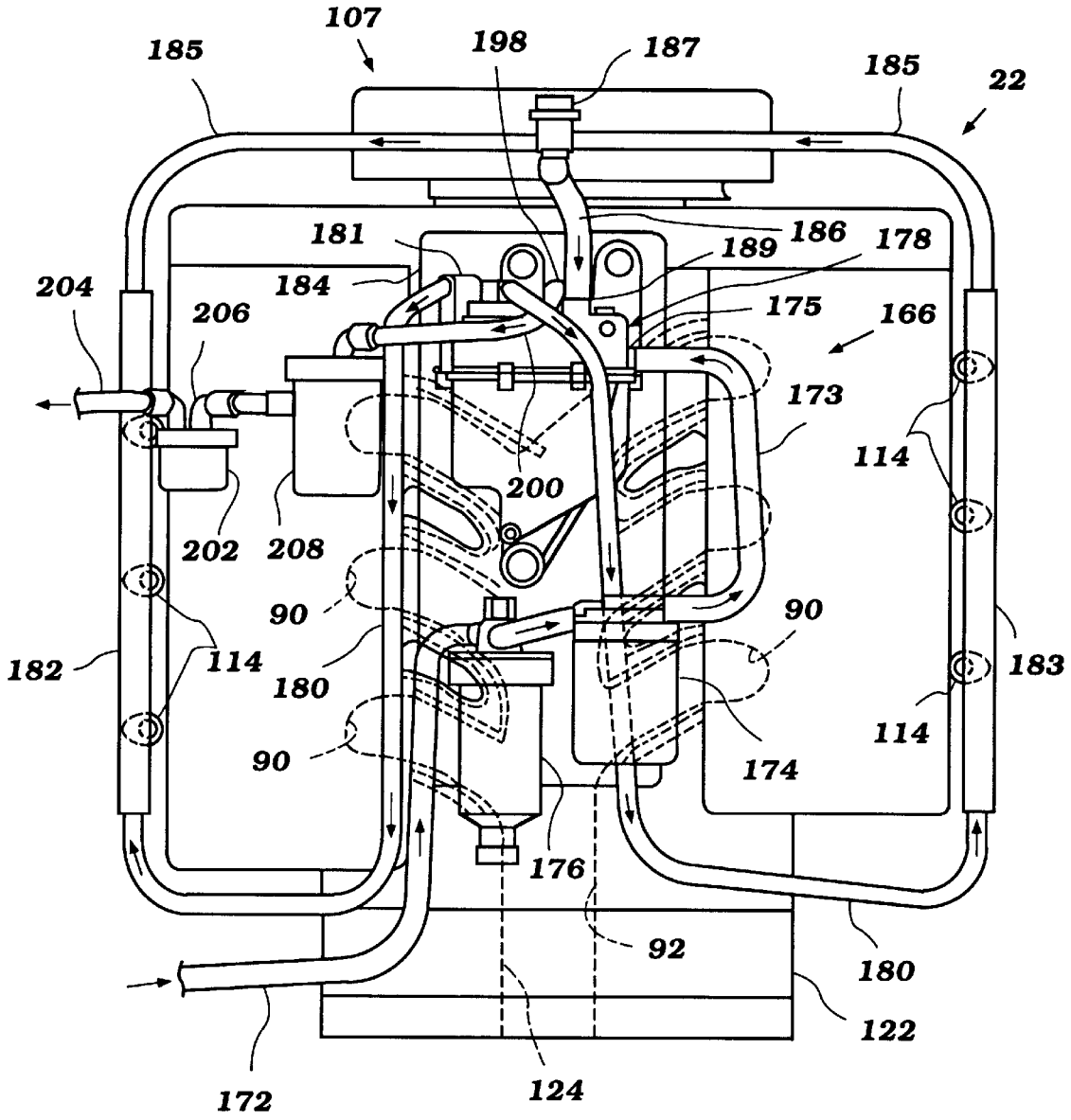
FIG. 3 is a first end view of the engine illustrated in FIG. 2 illustrating the fuel supply system.

A fuel supply system 166 is provided for delivering fuel to each combustion chamber 58 for combustion therein. FIGS. 1–3 illustrate a fuel supply system in accordance with a first embodiment of the present invention. In this embodiment, fuel is pumped from a fuel source, such as a tank 168 on board the watercraft 24, through a supply line 172 by a low pressure pump 174. This pump 174 may be of the diaphragm type. Preferably, the pumped fuel is passed through a filter 176 positioned along the line 172.

The fuel is delivered by the pump 174 through a fuel line 173 to an inlet pipe 175 vapor separator 178, described in greater detail below. After separation of air from the fuel, a high pressure pump 179 delivers fuel under high pressure from the vapor separator 178 through a fuel delivery pipe 181 to a pair of high pressure supply lines 180. These lines 180 lead to a pair of fuel rails 182,183, one each of the fuel rails corresponding to one of the cylinder banks 55,57. Fuel passes from each rail 182,183 through a passage extending therefrom to a fuel injector 114. In this embodiment, fuel is supplied to the bottom of each fuel rail 182,183 (corresponding to the bottom end of the engine) and passes upwardly through the fuel rails 182,183 to a return line 185.

Fuel supplied to the fuel rails 182,183 but not delivered by the fuel injectors is routed back to the vapor separator 178 through the return line 185. A pressure regulator 187 is positioned at the junction of the return line 185 extending from each fuel rail 182,183. The pressure regulator 187 is preferably positioned at the top end of the engine 22 above the vapor separator 178. A single return line 186 extends from the pressure regulator 186 downwardly to a return pipe 189 leading into the vapor separator 178. The pressure regulator 187 is arranged to maintain the fuel pressure within the fuel rails 182,183 at a high pressure, but yet allows the un-delivered fuel to return to the separator, as is well known in the art.

As illustrated in FIG. 2, the vapor separator 178, low pressure fuel pump 174 and fuel filter 172 are all positioned in the valley of the engine 22. As illustrated in FIG. 3, the vapor separator 178 is positioned above the low pressure fuel pump 174 and the fuel filter 172, which are themselves generally positioned side-by-side. These components may be mounted elsewhere, but this arrangement provides for a preferred compact arrangement.

As best illustrated in FIG. 2, the vapor separator 178 is preferably mounted to and supported by the engine 22 through a support bracket 184. This bracket 184 preferably has a mounting plate portion to which the separator 178 is connected, and a pair of legs 186 extending from the plate to the cylinder heads 53,54 for spacing the plate portion from the engine 22 in supported fashion.

Figure 5:
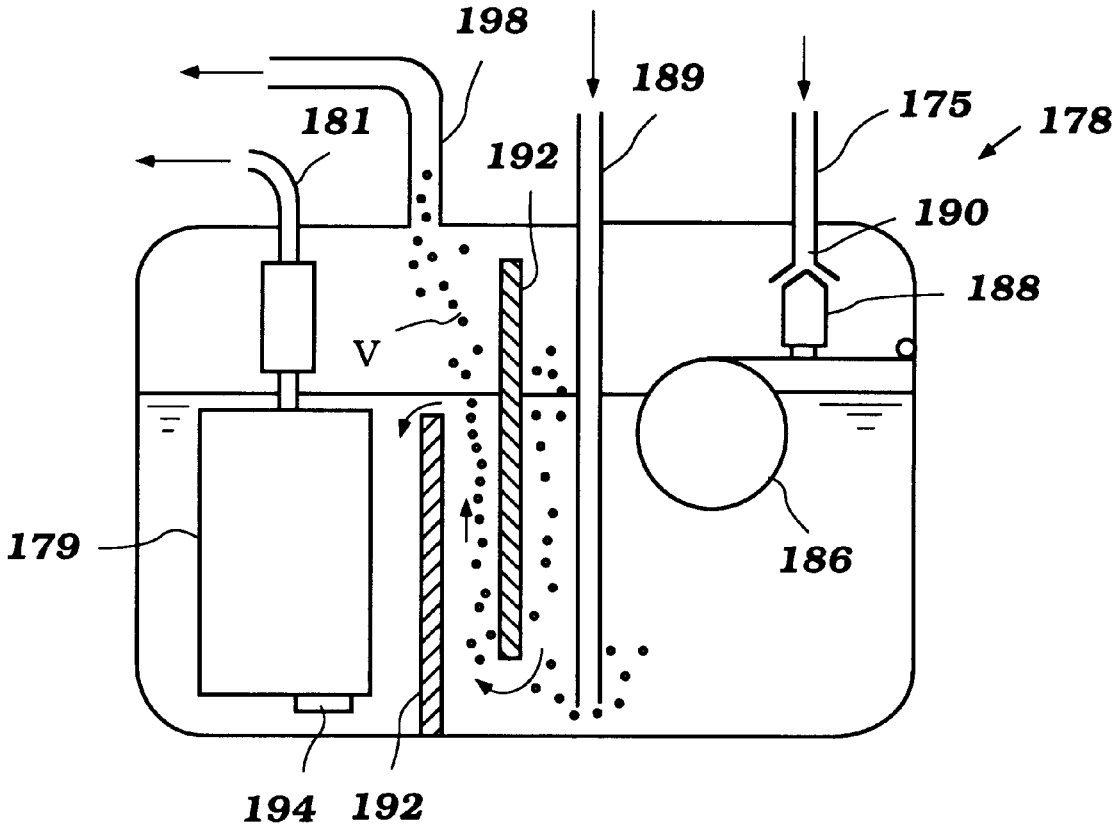
FIG. 5 is an enlarged cross-sectional view of a vapor separator of the fuel supply system illustrated in FIGS. 1–3 in accordance with a second arrangement thereof.

A first embodiment vapor separator 178 is illustrated in more detail in FIG. 5. As illustrated, the separator 178 comprises a tank. Fuel is delivered into the tank through the inlet pipe 175. A float 186 is positioned in the tank and connected to a needle 188. The needle 188 is arranged to extend into an outlet port 190 of the pipe 175 within the tank. As the fuel level rises in the tank, the float 186 rises and the needle 188 blocks the outlet port 190. Conversely, as the fuel level falls, the needle 188 is pulled out of the port 190 and fuel flows into the tank. In this manner, the delivery of fuel into the separator 178 is regulated.

In order to reduce fuel movement within the separator 178 to reduce vapor creation and to reduce the transmission of vapor to the high pressure fuel pump 179, one or more baffles 192 are positioned in the separator. As illustrated, a first baffle 192 generally permits only fuel flow along a bottom of the tank in the direction of the outlet 190 to the fuel pump 179, and a second adjacent baffle 192 only permits fuel flow in that same direction along the top surface of the fuel. This arrangement aids in permitting the escape of vapor V from the fuel into a top portion of the separator 178 and reduces the transmission of vapors to the inlet of the pump 179, and thus delivery of the vapor to the charge formers.

The fuel is drawn through an inlet 194 into the high pressure pump 179 and then delivered therefrom at high pressure into the delivery pip 181. As illustrated in FIG. 5, the pump 179 is positioned within the separator 178.

Figure 6:
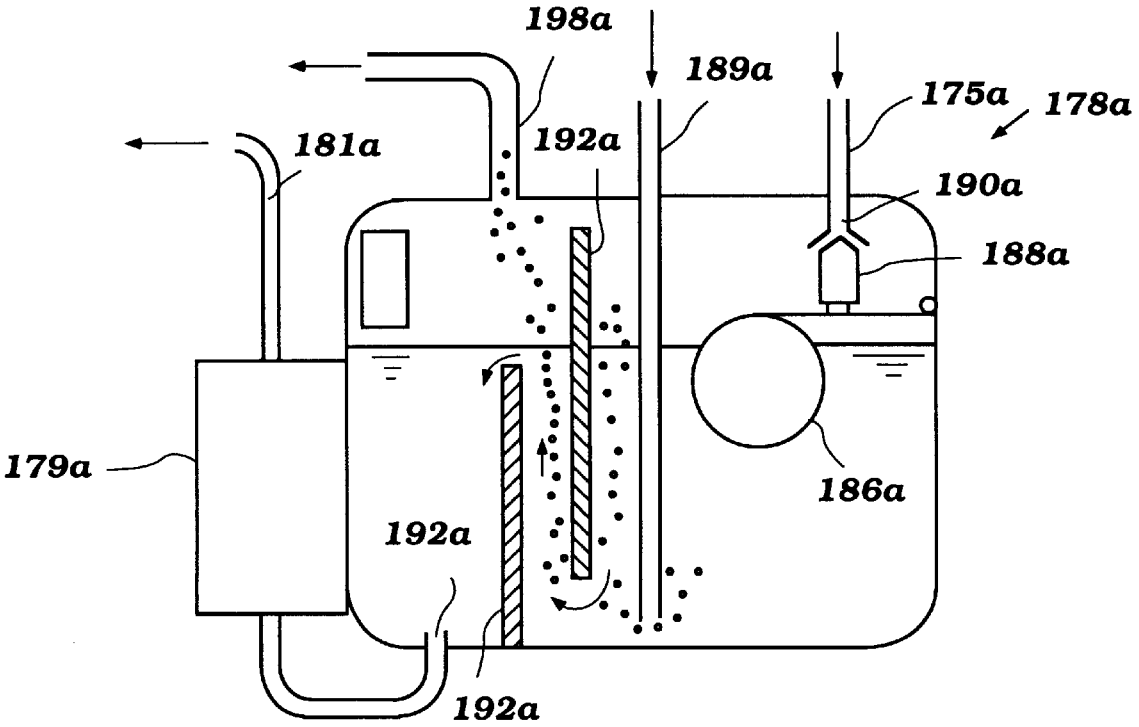
FIG. 6 is an end view of the engine opposite that illustrated in FIG. 3.

A second arrangement for a vapor separator 178*a* for use in the fuel system of the present invention is illustrated in FIG. 6. In the illustration and description of this embodiment, like numerals have been used with like parts to those used to describe and illustrate the first embodiment, except that an "a" designator has been added to all reference numerals thereof. In this embodiment, the high pressure fuel pump 179*a* is positioned outside of the separator 178*a*.

Regardless of the arrangement of the vapor separator 178, and referring to FIG. 2 primarily, a vapor discharge is provided for routing vapor V from the separator 178. In a first arrangement, a discharge hose 196 extends from a vapor tube 198 leading from the separator 178. This hose 196 extends to a point external to the cowling 30 of the motor 20 for routing the vapor to a location outside of the motor 20. This hose 196 may, for example, lead back to the fuel tank 168 in the watercraft 24 or simply discharge into the atmosphere or body of water in which the motor 20 is operating.

In this manner, vapor within the fuel system 166 is at least partly removed therefrom before being pumped by the high pressure fuel pump 179 and delivered to the injectors 114. In this manner the effect of the vapor upon the engine running conditions is lessened.

In an alternate arrangement, a hose 200 extends from the tube 198 to a control valve 202. A first line 204 extends from the valve 202 through the cowling 30 to a point external to the motor 20. A second line 206 leads from the valve 202 to the intake system 72. Preferably, a canister 208 is positioned along the hose 200 between the separator 178 and the valve 202. The canister 208 is adapted to catch or contain liquid fuel.

The second line 206 preferably extends to either a first discharge outlet 210 at the merge of the branch pipes 75, a second outlet 212 along the main pipe 74, or a third outlet 214 at the silencer. In all positions, the vapor is delivered into the intake air passing therethrough and delivered into the engine 22. These particular outlet positions are advantageous since the vapor is distributed into air which is then generally equally distributed to all of the cylinders or combustion chambers of the engine 22. In this manner, not just the air/fuel ratio to a single cylinder or combustion chamber is affected, and the effect of the vapor upon the air/fuel ratio of individual cylinders is reduced.

Preferably, the valve 202 is controlled in a manner whereby when the engine 22 is running at a low speed or load, the vapor is routed through the first line 204 to a point external to the motor. On the other hand, when the engine is running at a higher speed and the fuel requirements are greater, the valve 202 preferably routes the vapor through the second line 206 to the intake system.

The canister 208 is preferably adapted to store the fuel when the engine speed is low and the vapor is routed through the first line 204, but to distribute the fuel to the intake system when the engine is running at higher speed and the flow through the line 206 is greater.

Figure 7:
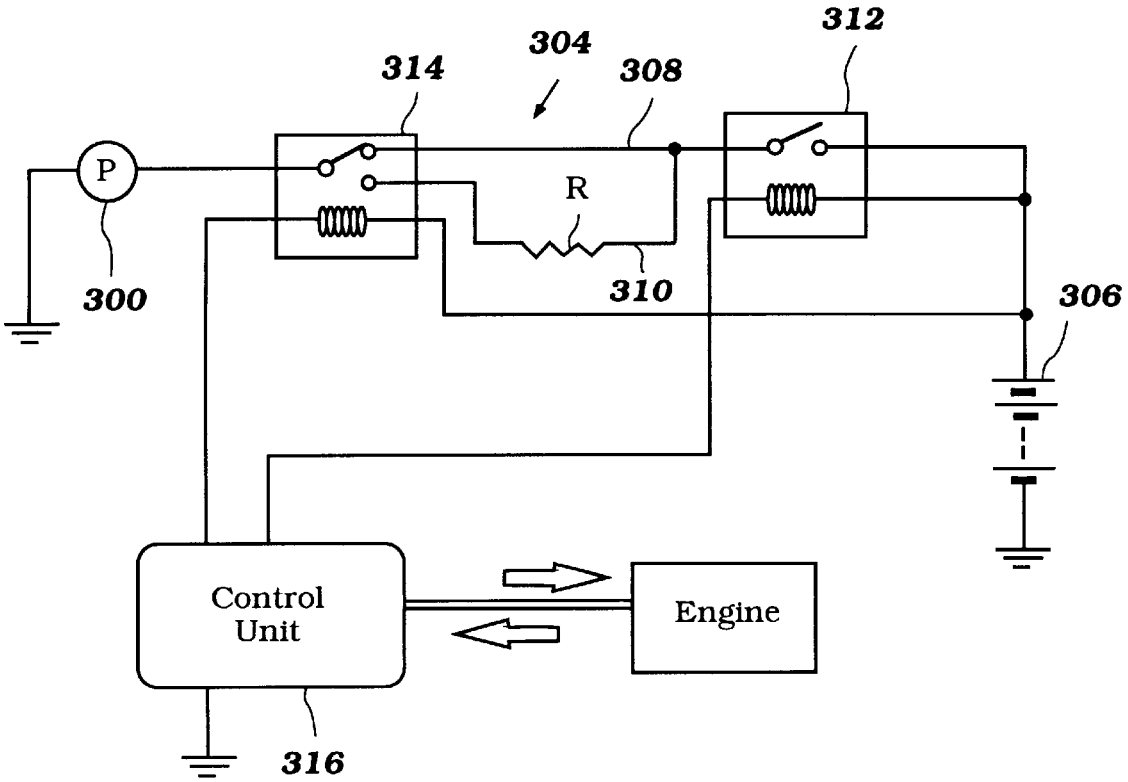
FIG. 7 illustrates a control circuit for a fuel supply system in accordance with a second embodiment of the present invention.

A fuel supply system in accordance with a second embodiment of the present invention is illustrated in FIG. 7. This fuel supply system includes means for controlling output fuel volume of a fuel supply pump 300 (this pump 300 generally corresponds to the high pressure pump 179 of the fuel supply system of the previous embodiment). This means for controlling preferably comprises a voltage control circuit 302.

As illustrated, the voltage control circuit 302 comprises a feed circuit 304 linking the pump 300 with a power source 306. The feed circuit 304 includes a high voltage circuit 308 and a low voltage circuit 310. A main power switch 312 is provided along the feed circuit 304, as is a shift switch 314. A control unit 316 is provided for controlling the switches 312,314.

The control unit 316 is arranged to close the main power switch 312 for powering the fuel pump 300, such as when the engine is started, and open the switch to turn off the pump 300, such as when the engine is stopped.

Figure 8:
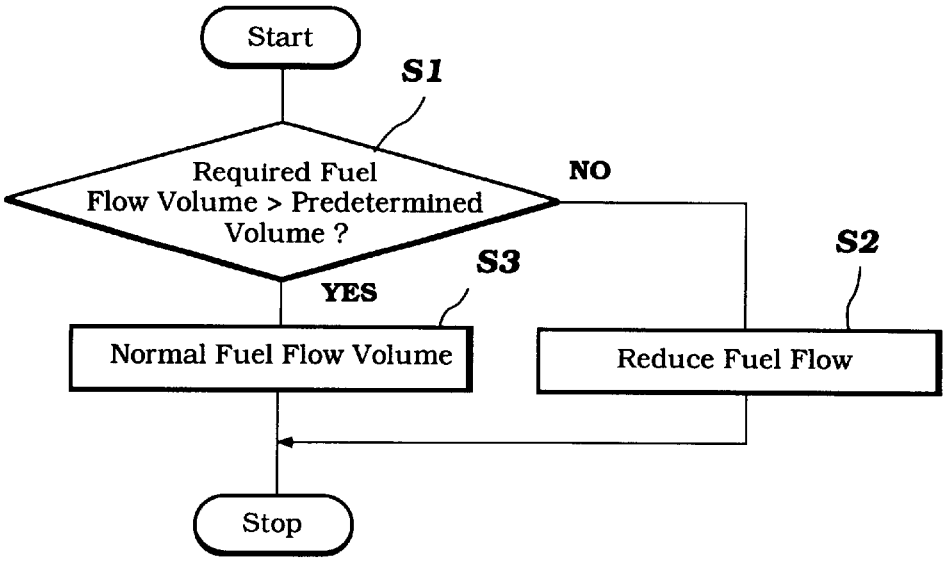
FIG. 8 schematically illustrates a control strategy for a control unit of the control circuit illustrated in FIG. 7.
Figure 9:
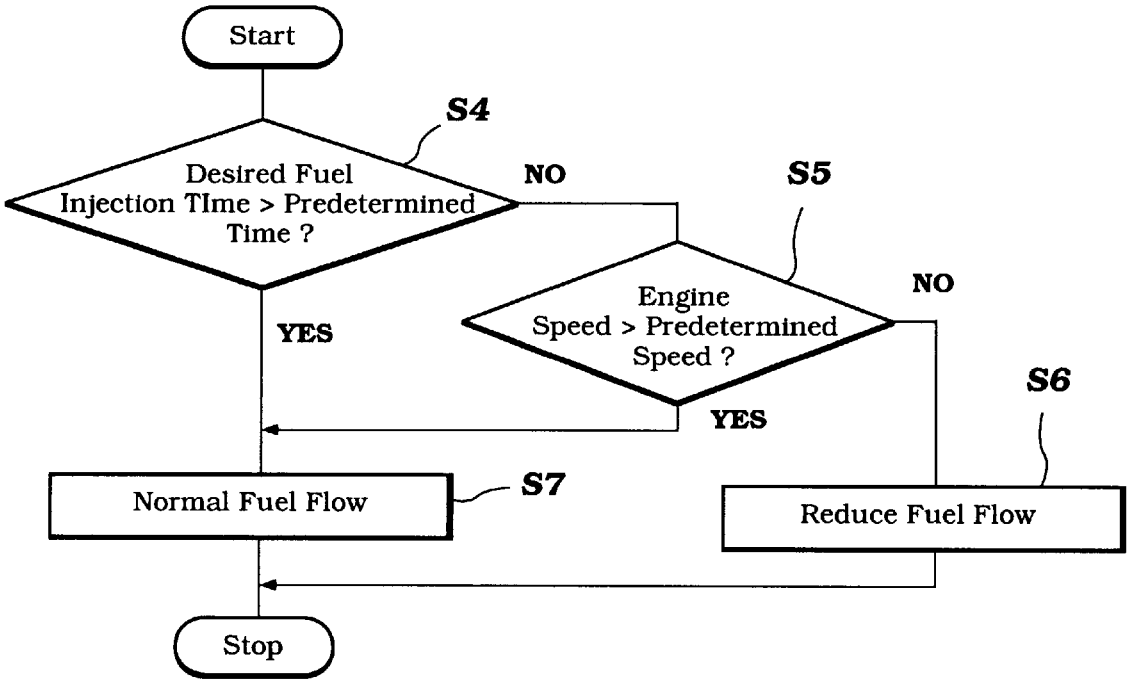
FIG. 9 schematically illustrates another control strategy for a control unit of the control circuit illustrated in FIG. 7.

The control unit 316 is also arranged to control the shift switch 314 for controlling the speed of the pump 300. The control strategy for the control unit 316 is illustrated in FIGS. 8 and 9. As illustrated in FIG. 8, if the fuel required by the engine is above a predetermined value determined for a particular engine operating condition (step S1), then the control unit 316 moves the shift switch 314 to the position illustrated in FIG. 7 in which the pump 300 is powered through the high voltage circuit 308 (step S3). In this manner, the pump 300 is powered at maximum voltage, providing maximum fuel output to the engine.

If the fuel required by the engine is below the predetermined value, then the control unit 316 moves the shift switch 314 to the low voltage circuit 310 (step S2). At this time, power is provided from the power source 306 through a resistor R to the pump 300 at reduced voltage. The pump 300 is thus operated at a lower speed and less fuel is pumped to the engine.

The control unit 316 may also be operated in accordance with the control strategy illustrated in FIG. 9. In this control strategy, the control unit 316 moves the shift switch 314 to the low voltage circuit 3 10 in the event the desired fuel injection time is less than a predetermined time (step S4) and the engine speed is less than a predetermined engine speed (step S5). Otherwise (step S7) the control unit 316 moves the shift switch 314 to the high voltage circuit 308.

In accordance with this embodiment of the present invention, the volume of fuel supplied by the pump 300 varies depending on engine speed. Because of this, the fuel supplied to the charge formers (such as the injectors 114 of the first embodiment) corresponds to that which is delivered. This eliminates the need for a fuel return for undelivered fuel back to the fuel supply, such as the vapor separator.

In an arrangement where the fuel pump 300 delivers fuel from a vapor separator, the elimination of the fuel return back to the vapor separator reduces the creation of vapor within the fuel system. This means that the vapor transmission to the charge formers is reduced, so that the air/fuel ratio may be accurately managed. In addition, because of the reduction in vapor production, the vapor relief line may be eliminated, further simplifying the fuel supply system.

Figure 10:
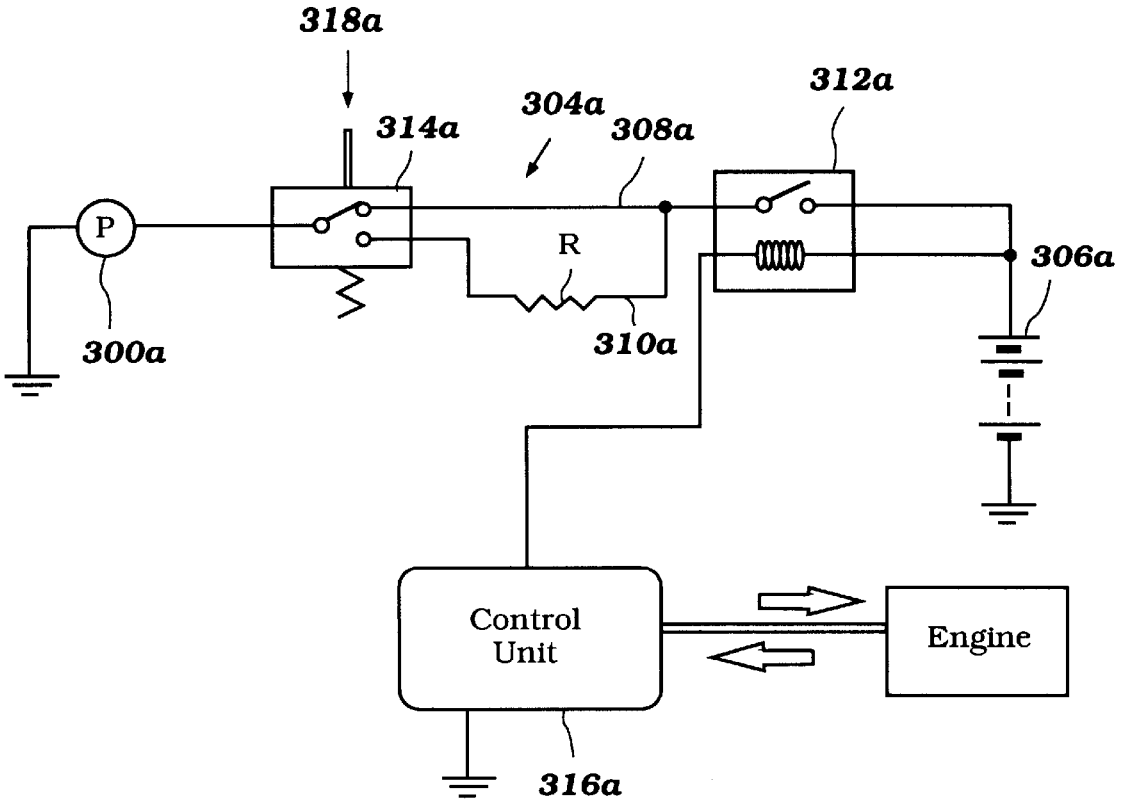
FIG. 10 illustrates a control circuit for a fuel supply system in accordance with a third embodiment of the present invention.

FIG. 10 illustrates an alternate embodiment control system from that illustrated in FIG. 9. In the description and illustration of this embodiment, like reference numerals have been used with similar parts to those in the embodiment illustrated in FIG. 9, with an "a" designator added to all of the reference numerals of this embodiment.

This embodiment is similar to the last, except that the shift switch 314*a* is not controlled by the control unit 316*a*. The shift switch 314*a* includes a pressure line 318*a* in communication with a fuel outlet or delivery line (not shown) leading from the pump 300*a*.

In the event the fuel pressure at the outlet of the pump 300*a* exceeds a predetermined value (i.e. too much fuel is being delivered by the pump than is being delivered by the fuel delivery devices, such as fuel injectors), the shift switch 318*a* is arranged to move to the low voltage circuit 310*a* setting for reducing the fuel delivery rate. Alternatively, if the pressure at the outlet of the pump 300*a* is low, then the switch 314*a* is biased into the high voltage circuit 308*a* position to maintain high pump output.

This arrangement is advantageous, since it eliminates the need for use of a control unit in controlling the position of the shift switch 314*a*. In addition, it is noted that a fuel return line may be provided from the outlet of the pump 300*a* back to the pump or fuel supply for routing some of the fuel delivered by the pump 300*a* away from the delivery line to the fuel injectors or other fuel delivery devices. A pressure valve is preferably provided for opening the return line when the pressure in the delivery line exceeds a predetermined value.

Figure 11:
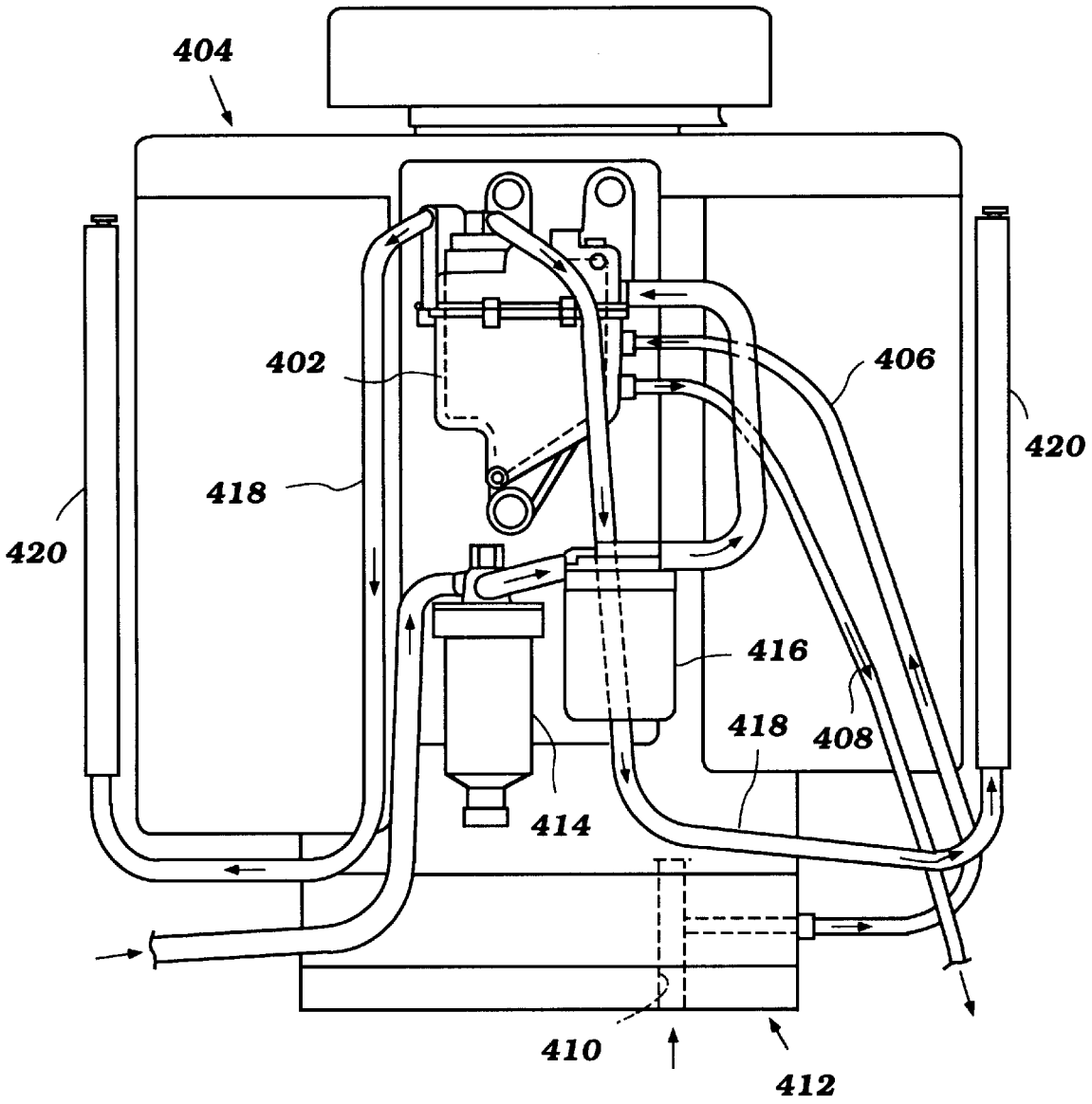
FIG. 11 is an end view of an engine powering an outboard motor like that illustrated in FIG. 1, but including a fuel supply system in accordance with a fourth embodiment of the present invention.

FIG. 11 illustrates a fourth embodiment fuel supply system in accordance with the present invention. In this embodiment, the fuel supply system again includes a vapor separator 402. A cooling jacket (not shown) is provide around at least a portion of the vapor separator 402 or between the vapor separator 402 and the engine 404. Coolant, preferably in the form of cooling water which is used to cool the engine 404, is delivered through a delivery line 406 to the jacket, and then discharged through a line 408.

The coolant may be delivered to the cooling jacket from a number of sources. In the embodiment illustrated, coolant flows from a main coolant supply passage 410 through the exhaust guide 412 of the engine.

Because of the cooling effect on the fuel, the vapor creation rate within the fuel system is lessened. This not only reduces the transmission of vapor to the charge formers, but simplifies the fuel system since the need for a vapor relief line may be eliminated. In this embodiment, fuel is pumped from a fuel supply by a low pressure pump 414 through a fuel filter 416 and delivered to the vapor separator 402. A high pressure pump (not shown) delivers fuel from the separator 402 through a pair of deliver lines 418 and corresponding fuel rails 420. In this regard, the control circuit illustrated in FIGS. 7 or 10 may be used to control the high pressure pump having the advantages stated above.

In accordance with the present invention, a fuel supply system is provided which includes a vapor separator and a means for reducing the transmission of vapor to a fuel pump which delivers fuel from the separator and delivers it to the charge former(s) of the engine.

Of course, the foregoing description is that of preferred embodiments of the invention, and various changes and modifications may be made without departing from the spirit and scope of the invention, as defined by the appended claims.

What is claimed is:

1. A fuel supply system for an engine powering an outboard motor, the engine positioned in a cowling of the motor and arranged to drive a water propulsion device of the motor, the engine having at least one combustion chamber, the fuel supply system including a vapor separator, first pump means for delivering fuel to said vapor separator, second pump means for delivering fuel from said vapor separator to a fuel injector for providing fuel to said at least one combustion chamber at the full pressure generated by said second pump, and means for reducing the transmission of vapor within said fuel supply system to said fuel injector, said means for reducing including means for controlling said second pump means between a first output level and a second output level for controlling the rate of fuel delivery to said fuel injector based upon a fuel requirement of said engine for eliminating the use of a pressure regulator having a fuel return from said fuel injector to said vapor separator and vapor production is reduced.

2. The fuel supply system in accordance with claim 1, wherein said second pump means comprises an electrical pump and said means for controlling includes a high voltage circuit for operating said pump at a high speed and a low voltage circuit for operating said pump at a low speed.

* * * * *